US005388694A

United States Patent [19]

Arendt

[11] Patent Number: 5,388,694

[45] Date of Patent: Feb. 14, 1995

[54] WRENCH HOLDER/ORGANIZER FOR TOOL BOX

[76] Inventor: Randall R. Arendt, 62949 New Haven Rd., Ray, Mich. 48096

[21] Appl. No.: 61,808

[22] Filed: May 17, 1993

[51] Int. Cl.[6] ..... B65D 85/20

[52] U.S. Cl. ..... 206/376; 206/373; 206/377; 211/70.6

[58] Field of Search ..... 206/373, 376, 377; 211/70.6

[56] References Cited

U.S. PATENT DOCUMENTS

| | | | |
|---|---|---|---|
| D. 163,263 | 5/1951 | Dodd et al. | 206/377 X |
| 1,929,072 | 10/1933 | Little | 206/377 |
| 2,510,260 | 6/1950 | Searfoss | 206/377 |
| 3,702,136 | 11/1972 | Albertson | 206/376 X |
| 3,837,477 | 9/1974 | Boudrea | 206/376 X |
| 3,997,053 | 12/1976 | Bordhu | 206/377 |
| 4,705,168 | 11/1987 | Ward | 206/373 |
| 4,767,006 | 8/1988 | Wasern | 206/377 |
| 4,911,297 | 3/1990 | Suburn | 206/376 |

FOREIGN PATENT DOCUMENTS

| | | | |
|---|---|---|---|
| 323476 | 1/1930 | United Kingdom | 206/373 |

*Primary Examiner*—Bryon P. Gehman

*Attorney, Agent, or Firm*—David W. Schumaker

[57] ABSTRACT

The instant invention provides for a wrench tool organizer and storage device. The organizer and storage device includes a single, flat, planar base having an upper face and a lower face and at least one pair of wrench retaining and sorting projections spacedly attached to the upper face of the planar base so as to accommodate a wide variety of wrench sizes, each wrench retaining and sorting projection of the pair being positioned relative to the other in a manner which allows one or more wrenches to be retained by both projections of the pair at the same time. Additionally, the device includes one or more allen wrench head retaining and sorting projections attached to the upper face of the planar base for holding and sorting the head of at least one allen wrench and at least one allen wrench handle retaining and sorting projection attached to the upper face of the planar base for holding and sorting the drive handle of at least one allen wrench. The allen wrench head retaining and sorting projections and the allen wrench handle retaining and sorting projections being spacedly attached to the planar base so as to allow at least one allen wrench to engage both the head and the handle retaining and sorting projections at the same time.

13 Claims, 4 Drawing Sheets

WRENCH HOLDER/ORGANIZER FOR TOOL BOX

FIELD OF THE INVENTION

This invention relates generally to tool holders and specifically to a durable wrench tool holder/organizer designed to fit into a tool box.

BACKGROUND OF THE INVENTION

A common problem encountered by mechanics and other workmen is storage/organization of wrenches and allen wrenches in tool boxes. Commonly wrenches and allen wrenches are haphazardly strewn about in one or more compartments of conventional tool boxes. The storage/organization problem is particularly acute when the workman owns multiple graduated sets of wrenches and allen wrenches, as is common in the workplace today due to the dual requirements of both metric and standard english units of measure. Various attempts to solve this storage/organization problem in the prior are have resulted in somewhat less than adequate devices.

Wrench Holders

U.S. Pat. No. 3,702,136 dated Nov. 7, 1972 to Alberton, describes a wrench holder which has a two part adjustable base and a fastener to hold the parts together. While this a workable holder, the wrenches are held therein such that the size of all but the end wrenches is difficult to determine. Also, the holder does nothing to alleviate the allen wrench problem, and is difficult to store in tool boxes.

U.S. Pat. No. 4,705,168 dated Nov. 10, 1987 to Ward discloses tool box drawer dividers which are used as wrench holders and drawer partitioning devices. While these dividers make adequate wrench holders, they have a tendency to slip from their friction fit in the tool box drawer and drop the wrenches. Also as is the case with all prior art wrench holders, there is again no provisions made for allen wrenches, except for perhaps dumping them in the drawer between the partitions, which is hardly practical for a mechanic who may own multiple graduated sets thereof.

U.S. Pat. No. 4,911,297 dated Mar. 27, 1990 to Suburu describes a wrench holder which, as is the case with the Alberton holder above, holds the wrenches in such a way as to make identification of the wrench size difficult. The Suburu holder also uses a locking bar to hold the wrenches in place (presumably for portability) making withdrawal and replacement of the desired wrenches time consuming. Again, no provision is made for allen wrenches.

Finally, U.S. Pat. No. 4,997,085 dated Mar. 5, 1991 to Brennan discloses a wrench holder which stores the wrenches in a lying flat manner. The wrenches are held into place by posts which engage both of the drive ends of the wrench. For greater storage capacity, many wrenches must be stacked upon one another, which makes both identification and access difficult for underlying wrenches. Also, no provisions are made for graduated sets of wrenches and absolutely no accommodations are contemplated for allen wrenches.

Allen Wrench Holders

U.S. Pat. No. 3,997,053 dated Dec. 14, 1976 to Bondhus discloses an allen wrench holder, which is essentially a block of plastic with imperfectly round holes cut therein. The handles of the allen wrenches are slid into these holes while the allen wrench is turned at an angle and the wrench is locked into place by turning so that one or more of the hex ridges thereof digs itself into the plastic. This device does not allow for easy access of the allen wrenches because the wrench must be turned to be freed and any wrenches which are larger must also be turned so as to uncover the desired allen wrench. The holder also does not allow easy determination of allen wrench size and does not provide any type of organization/storage of conventional wrenches.

Finally, U.S. Pat. No. 4,767,006 dated Aug. 30, 1988 to Wasem discloses a holder for allen wrenches. The holder comprises a cylinder having longitudinal slots cut around the circumference thereof and radial holes drilled at alternating ends of the longitudinal slots. The allen wrenches are held in the slots with their respective heads fitting in the drilled holes. The cylinder is fitted within an annular cylinder into which one retrieving slot is cut. When the inner cylinder is turned, one or another allen wrench is accessible at the retrieving slot. This device does not allow for access to more than one allen wrench at a time and does not allow for easy access of the tools. The device also does not allow for storage/organization of conventional wrenches.

There is therefore a need in the art for a wench holder/organizer device which allows for storage/organization of multiple graduated sets of wrenches and allen wrenches. The device should allow for easy identification and access of any an all wrenches at any time. The device should provide stable storage in tool boxes and be easy to make and use. The device should be above all durable and economical.

These and other aspects, objects and embodiments will become apparent upon consideration of the attached detailed description and drawings.

SUMMARY OF THE INVENTION

The instant invention provides for a wrench tool organizer and/or storage device which meets the requirements set forth above. The organizer/storage device includes a single, flat, planar base having an upper and a lower face. The device also includes one or more pair of wrench retaining/sorting projections spacedly attached to the upper face of the planar base so as to accommodate a wide variety of wrench sizes, each wrench retaining/sorting projection of the pair being positioned relative to the other in a manner which allows one or more wrenches to retained by both means of said pair at the same time. Additionally, the device includes one or more allen wrench head retaining/sorting projections attached to the upper face of the planar base for holding and sorting the heads of one or more allen wrenches and one or more allen wrench handle retaining/sorting projections attached to the upper face of the planar base for holding and sorting the drive handles of one or more allen wrenches. The allen wrench head retaining/sorting projections and the allen wrench handle retaining/sorting projections being spacedly attached to the planar base so as to allow one or more allen wrenches to engage both the head and the handle retaining/sorting projections at the same time.

Preferably, each individual of the pair of wrench retaining/sorting projections includes a planar protrusion fixedly attached to the planar base and fixedly oriented such that the plane of the planar protrusion is perpendicular to the plane of the planar base. The edge portion of the planar protrusion which is remote from the planar base has one or more indentations for retaining the handles of one or more wrenches, thereby resisting unwanted movement. More preferably, the wrench tool organizer and/or storage device includes more than one pair of wrench retaining/sorting projections.

The planar protrusions of one or more of the pairs of wrench retaining/sorting projections may be attached to the planar base such that the plane of one of the planar protrusions is not parallel to the plane of the other of the planar protrusions, thereby allowing for retainment/storage of graduated sets of wrenches and the one or more indentations in the planar protrusions can be V-shaped indentations having a rounded bottom and one leg of the V-shape perpendicular to the plane of said planar base.

The V-shaped indentations may be graduated in width and depth along the length of the planar protrusions so as to aid in the accommodation of graduated sets of wrenches.

Also, the allen wrench head retaining/sorting projections preferably include one or more block shaped protrusions having one or more allen wrench head holding openings extending therethrough perpendicular to the plane of the planar base. The block shaped protrusion may be a rectangular block shaped protrusion which is affixed to the planar base so that the plane of one of the longest sides thereof is parallel to the plane of the planar base, and the one or more allen wrench head holding openings can be cylindrical openings having their axial dimension perpendicular to the plane of the planar base. The rectangular block shaped protrusion can preferably contains a plurality of the cylindrical openings having graduated diameters along the length of the rectangular block shaped protrusion so as to accommodate graduated sets of allen wrenches.

The allen wrench handle retaining/sorting projection is preferably a planar protrusion attached to the planar base and is oriented such that the plane of the planar protrusion is perpendicular to the plane of the planar base. Here again, as with the wrench retaining/sorting means, the edge portion of the planar protrusion which is remote from the planar base has one or more indentations for retaining the handles of one or more allen wrenches, thereby resisting unwanted movement. Preferably, the plane of the planar protrusion is not parallel to the plane of the longest sides of the rectangular block shaped protrusion, thereby accommodating graduated sets of allen wrenches having graduated handle lengths.

It is highly preferred that the planar base, the one or more pair of wrench retaining/sorting projections, the one or more allen wrench head retaining/sorting projections and the one or more allen wrench handle retaining/sorting projections are fabricated as a one piece unit and are fabricated from a durable plastic material.

DETAILED DESCRIPTION OF THE INVENTION

Figure 1:
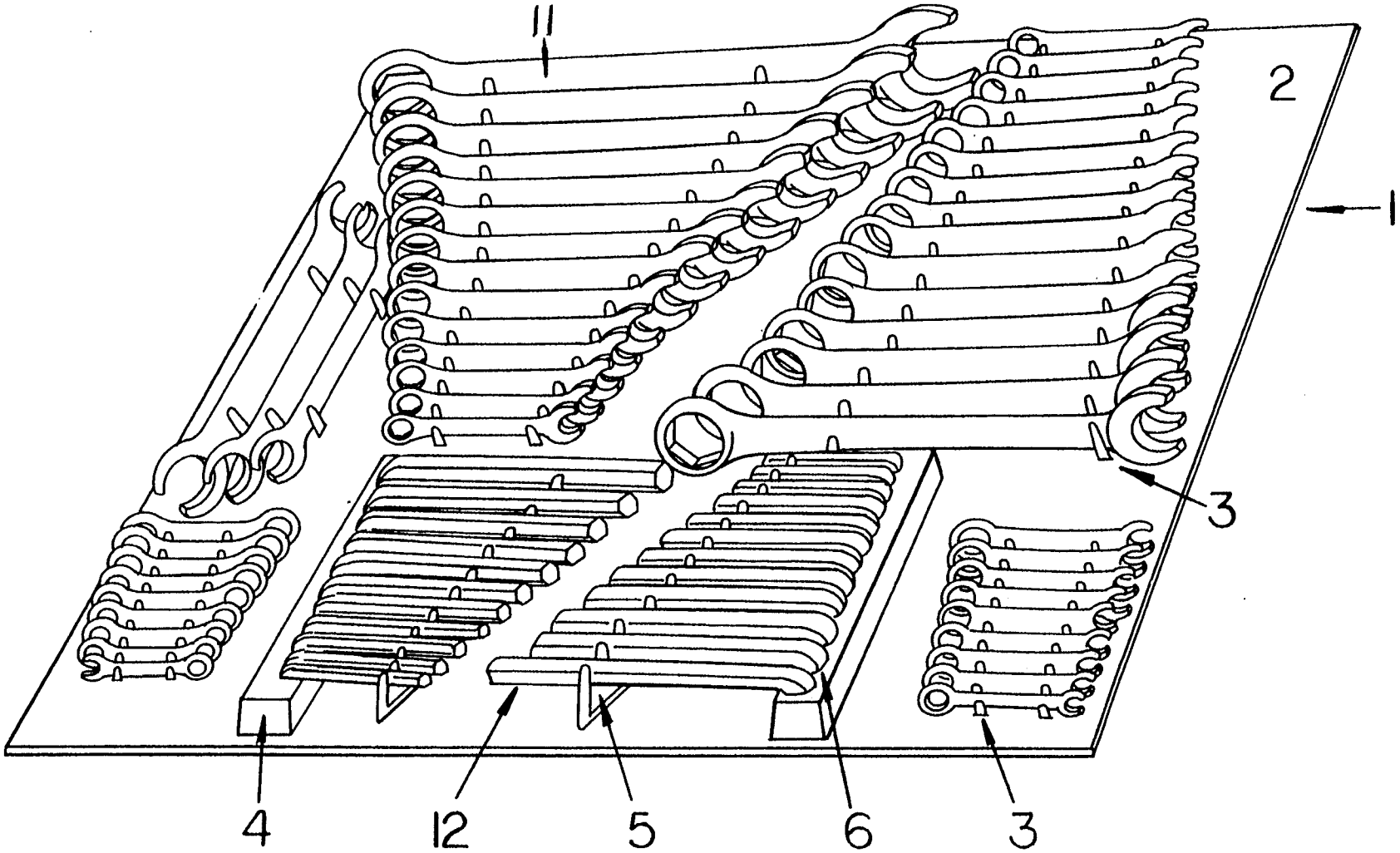
FIG. 1 is a schematic overhead view, not to scale, of a preferred embodiment of the wrench tool organizer/storage device of the present invention, specifically illustrating the placement of wrenches and allen wrenches in their respective holders.

Turning now to FIG. 1, there is shown therein, a schematic overhead view, not to scale, of a preferred embodiment of the wrench tool organizer/storage device 1 of the present invention. FIG. 1 illustrates the fashion in which the wrenches 11 and allen wrenches 12 are retained and sorted in the wrench tool organizer/storage device 1. Specifically, the wrench tool organizer/storage device of the present invention includes a flat planar base 2, which has numerous projections or protrusions attached thereto. The projections include one or more pairs of wrench retaining/sorting projections 3; one or more allen wrench head retaining/sorting projections 4 having one or more allen wrench head retaining openings 6; and one or more allen wrench handle retaining/sorting projections 5. The device is preferably a one piece unit and is molded from a durable plastic material. The length and width of the planar base 2 are preferably about 22 inches by about 16 inches, so that the device will fit into a drawer of most roll-away tool boxes.

Figure 2:
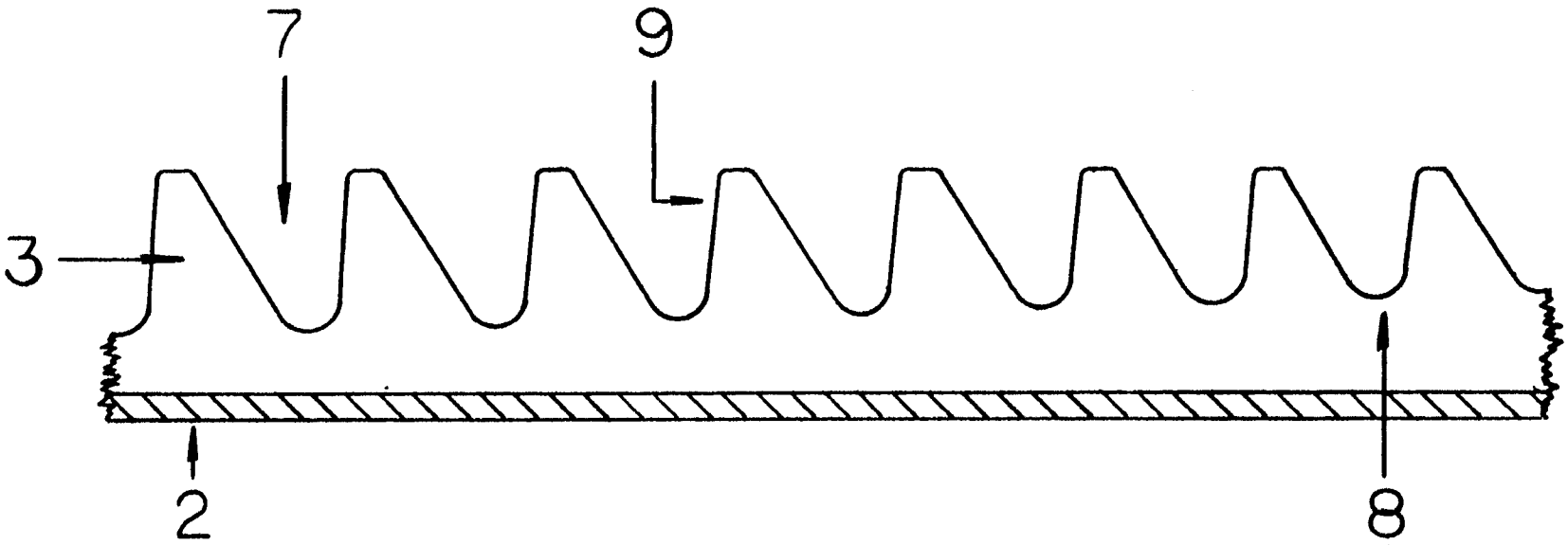
FIG. 2 is a sidelong, cut-away view, not to scale, of the wrench retaining/sorting projection of the wrench tool organizer/storage device of the present invention, specifically illustrating the V-shaped indentions therein.

Turning next to FIG. 2, there is depicted therein a sidelong, cut-away view, not to scale, of one wrench retaining/sorting projection 3 of the wrench tool organizer/storage device 1 of the present invention. The projections 3 are preferably planar protrusions 3 which are attached to the planar base 2 such that the plane of the planar protrusions 3 are perpendicular to the plane of the planar base 2. The protrusions are attached to the planar base 2 in pairs. The edge of each protrusion which is remote from the planar base has indentations 7 in which the handle portion of wrenches rest. The indentations 7 are shaped to help stored wrench resist unwanted movement. Most preferably the indentations 7 are V-shaped with a rounded bottom 8 and one leg of the V-shape 9 perpendicular to the plane of the planar base 2. The indentations 7 may decrease in depth along the length of the protrusions 3, if desired, when accommodating graduated sets of wrenches. The pairs of planar protrusions 3 can be attached to the planar base 2 such that the plane of one protrusion is parallel to the plane of the other protrusion. On the other hand, the planar protrusions 3 may be attached to the base 2 such that the planes of the protrusions are not parallel, to thereby accommodate graduated sets of wrenches having graduated lengths.

Figure 3:
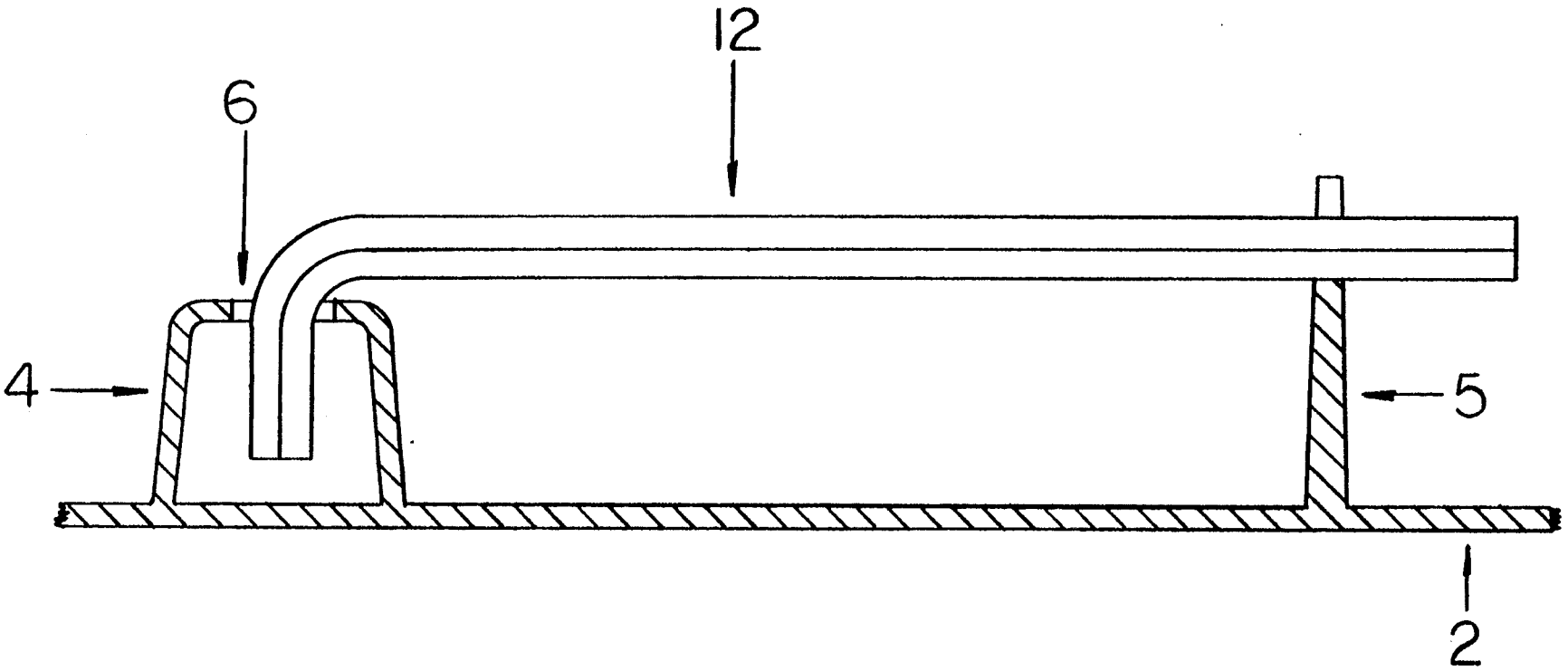
FIG. 3 is an edgelong, cut-away view, not to scale, of the allen wrench head and handle retaining/sorting projections of the wrench tool organizer/storage device of the present invention, specifically depicting the fashion in which an allen wrench is held thereby.

Referring now to FIG. 3, there is shown therein an edgelong, cut-away view, not to scale, of the allen wrench head retaining/sorting projection 4 and allen wrench handle retaining/sorting projection 5 of the wrench tool organizer/storage device of the present invention. The fashion in which the allen wrench 12 is held in the head and handle retaining/sorting projections is clearly depicted in FIG. 3. The allen wrench head retaining/sorting projection 4 is preferably a blocked shaped protrusion which is attached to the planar base 2. More preferably, the block shaped protrusion 4 is a rectangular block shaped protrusion which is affixed to the planar base 2 so that the plane of one of the longest sides thereof is parallel to the plane of the planar base 2. The block shaped protrusion has one or more allen wrench head holding openings 6 therein, and preferably the allen wrench head holding openings 6 are cylindrical openings having their axial dimension perpendicular to the plane of said planar base 2. The cylindrical allen wrench head holding openings 6 may be arranged in order of increasing diameter across the length of the rectangular blocked shaped protrusion 4, if desired, to accommodate graduated sets of allen wrenches. The handles of each allen wrench 12 being retained and sorted by allen wrench handle retaining-/sorting projection 5 which is more clearly shown in FIG. 4.

Figure 4:
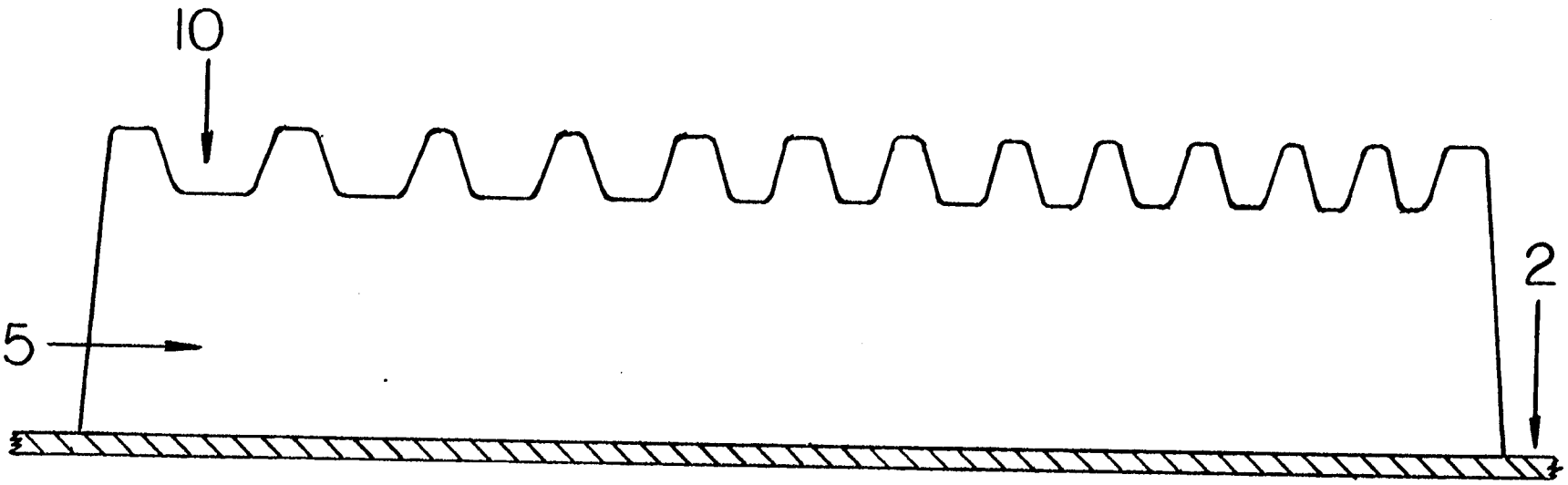
FIG. 4 is a sidelong, cut-away view, not to scale, of the allen wrench handle retaining/sorting projection of the wrench tool organizer/storage device of the present invention, specifically illustrating the handle holding indentions therein.

Turning now to FIG. 4, there is shown a sidelong, cut-away view, not to scale, of the allen wrench handle retaining/sorting projection 4 of the wrench tool organizer/storage device 1 of the present invention. The allen wrench handle retaining/sorting projection 4 is preferably a planar protrusion which is attached to he planar base 2 such that the plane of the planar protrusion is perpendicular to the plane of the planar base 2. The edge portion of the planar protrusion 5 which is remote from the planar base 2 has one or more allen wrench handle sorting indentations 10 for retaining the handles of one or more allen wrenches 12, thereby resisting unwanted movement thereof. Preferably, the plane of the planar protrusion is not parallel to the longest side of the rectangular block shaped protrusion, thereby accommodating graduated sets of allen wrenches having graduated handle lengths. Similar to the diameters of the allen wrench head holding openings 6, the size of the allen wrench handle sorting indentations 10 may increase in size along the length of planar protrusion 5.

In summary the present invention has met the objectives that were stated hereinabove. The instant invention is a simple, one piece plastic device making it inexpensive to manufacture. Its size allows it to easily fit into the drawers of most roll-away tool boxes. The organizer holds a large variety of conventional wrenches and also provides adequate accommodations for graduated sets of allen wrenches. The wrenches and allen wrenches are easily identifiable and accessible providing quick and efficient use thereof.

The forgoing description of the preferred embodiment of the invention has been presented for the purpose of illustration and description. It is not intended to be exhaustive or limit the invention to the precise form disclosed. Many modifications and variations are possible in light of the above teachings. It is intended that the scope of the invention be limited not by this detailed description, but rather by the claims appended hereto.

I claim:

1. A wrench tool organizer and storage device comprising:

a. a single, flat, planar base, said base having an upper face and a lower face;

b. at least one pair of wrench retaining and sorting projection means spacedly attached to the upper face of said planar base so as to accommodate a wide variety of wrench sizes, each wrench retaining and sorting projection means of said at least one pair being positioned relative to the other in a manner which allows at least one wrench to be retained by both means of said pair at the same time;

c. at least one allen wrench head retaining and sorting projection means attached to the upper face of said planar base for holding the head of at least one allen wrench, said allen wrench head retaining and sorting projection means consists of least one block-shaped protrusion having at least one allen wrench head-holding opening extending therethrough, said opening being perpendicular to the plane of said planar base;

d. at least one allen wrench handle retaining and sorting projection means attached to the upper face of said planar base for holding and sorting the drive handle of at least one allen wrench;

said allen wrench head retaining and sorting projection means and said allen wrench handle retaining and sorting projection means being spacedly attached to said planar base so as to allow at least one allen wrench to engage both said allen wrench head retaining and sorting projection means and said allen wrench handle retaining and sorting projection means at the same time.

2. A wrench tool organizer and storage devices in claim 1, wherein each means of said at least one pair of wrench retaining and sorting projection means includes a planar protrusion fixedly attached to, said planar base, said planar protrusion being fixedly oriented such that the plane of said planar protrusion is perpendicular to the plane of said planar base, the edge portion of said planar protrusion which is remote from said planar base having at least one indentation for retaining the handle of at least one wrench, thereby resisting unwanted movement.

3. A wrench tool organizer and storage device as in claim 2, including a plurality of pairs of wrench retaining and sorting projection means.

4. A wrench tool organizer and storage device as in claim 3, wherein planar protrusions of at least one pair of said plurality of pairs of wrench retaining and sorting projection means are fixedly oriented and attached to said plane base such that the plane of one of each pair is not parallel to the plane of the other of that pair, thereby allowing for retainment and storage of graduated sets of wrenches.

5. A wrench tool organizer and storage device as in claim 4, wherein said at least one indentation is a V-shaped indentation having a rounded bottom and one leg of the V-shape perpendicular to the plane of said planar base.

6. A wrench tool organizer and storage device as in claim 5, including a plurality of V-shaped indentations which are graduated in width and depth along the length of said planar protrusions so as to accommodate graduated sets of wrenches.

7. A wrench tool organizer and storage device as in claim 1, wherein said at least one block-shaped protrusion is a rectangular block-shaped protrusion and is affixed to said planar base so that the plane of one of the longest faces thereof is parallel to the plane of said planar base, and wherein said at least one allen wrench head holding opening is a cylindrical opening, the axial dimension thereof being perpendicular to the plane of said planar base.

8. A wrench tool organizer and storage device as in claim 7, wherein said at least one rectangular block-shaped protrusion contains a plurality of said cylindrical openings having graduated diameters along the length of said rectangular block-shaped protrusion so as to accommodate graduated sets of allen wrenches.

9. A wrench tool organizer and storage device as in claim 8, wherein said allen wrench handle retaining and sorting projection means includes a planar protrusion fixedly attached to said planar base, said planar protrusion being fixedly oriented such that the plane of said planar protrusion is perpendicular to the plane of said planar base, the edge portion of said planar protrusion which is remote from said planar base having at least one indentation for retaining the handle of at least one allen wrench, thereby resisting unwanted movement.

10. A wrench tool organizer and storage device as in claim 9, wherein the plane of said planar protrusion is not parallel to the longest face of said rectangular block-shaped protrusion, thereby accommodating graduated sets of allen wrenches having graduated handle lengths.

11. A wrench tool organizer and storage device as in claim 1, wherein said allen wrench handle retaining and sorting projection means includes at least one planar protrusion fixedly attached to said planar base, said planar protrusion being fixedly oriented such that the plane of said planar protrusion is perpendicular to the plane of said planar base, the edge portion of said planar protrusion which is remote from said planar base having at least one indentation for retaining the handle of at least one allen wrench, thereby resisting unwanted movement.

12. A wrench tool organizer and storage device as in claim 1, wherein said planar base, said at least one pair of wrench retaining/sorting projection means, said at least one allen wrench head retaining and sorting projection means and said at least one allen wrench handle retaining and sorting projection means are fabricated as a one piece unit.

13. A wrench tool organizer and storage device as in claim 12 wherein said one piece unit is fabricated from a durable plastic material.

* * * * *